United States Patent [19]

Salminen

[11] Patent Number: 4,537,398

[45] Date of Patent: Aug. 27, 1985

[54] HOCKEY STICK HAVING LAMINATED BLADE STRUCTURE

[76] Inventor: Reijo K. Salminen, 1842 Academy Rd., Bellingham, Wash. 98225

[21] Appl. No.: 457,742

[22] Filed: Jan. 13, 1983

Related U.S. Application Data

[63] Continuation of Ser. No. 300,123, Sep. 8, 1981, abandoned, which is a continuation of Ser. No. 171,126, Jul. 22, 1980, abandoned, which is a continuation-in-part of Ser. No. 56,421, Jul. 10, 1979, Pat. No. 4,369,970.

[51] Int. Cl.[3] ..... A63B 59/12

[52] U.S. Cl. ..... 273/67 A; 273/DIG. 7; 156/330

[58] Field of Search ..... 273/73 F, 67 A, 67 D, 273/67 DA, 67 R, 73 R, 72 R, 167 R, 82 R; 124/23 R

[56] References Cited

U.S. PATENT DOCUMENTS 1,564,125 12/1925 Cordwell ..... 273/67 A 2,665,678 1/1954 Bear ..... 124/23 R

FOREIGN PATENT DOCUMENTS 463938 3/1950 Canada ..... 273/67 A 1093528 12/1967 United Kingdom ..... 273/67 A

*Primary Examiner*—Richard C. Pinkham

*Assistant Examiner*—Matthew L. Schneider

*Attorney, Agent, or Firm*—Hughes, Barnard & Cassidy

[57] ABSTRACT

The blade of the stick is formed by placing two blade sections against the lower tapered end of a handle of the stick. The two blade sections are each made as laminated sections, made up of two laminations of wood with a fiberglass layer therebetween. The grain of the two wood pieces of each blade section are offset 45° to one another for greater shear strength. The cavity between the two blade sections is filled with a pliable material that hardens to make the complete blade structure. The outer surfaces of the blade and the side surfaces of the handle are coated with layers of fiberglass.

3 Claims, 44 Drawing Figures

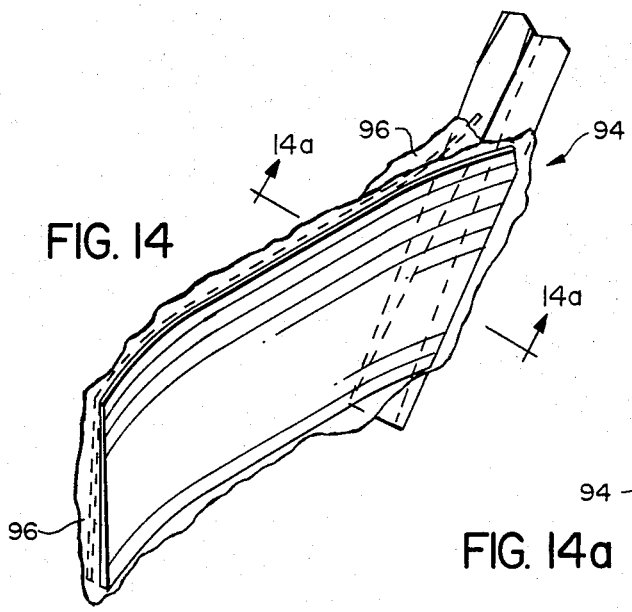
FIG. 14
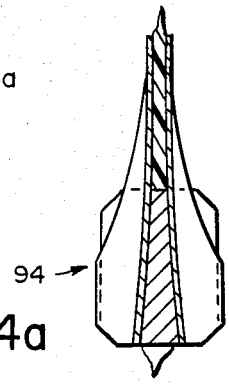
FIG. 14a
FIG. 15
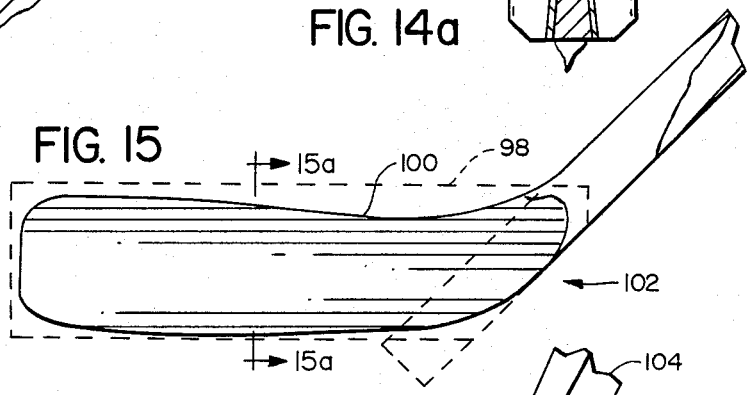
FIG. 15a
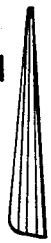
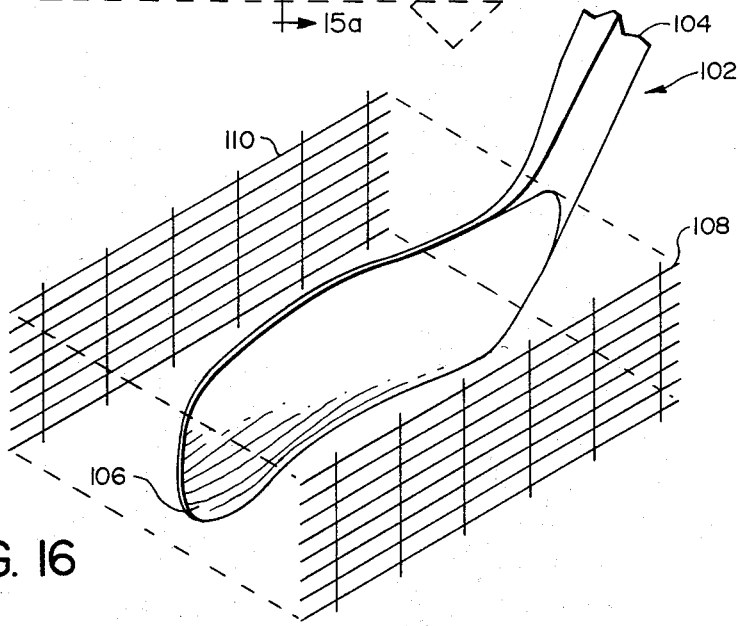
FIG. 16

FIG. 17
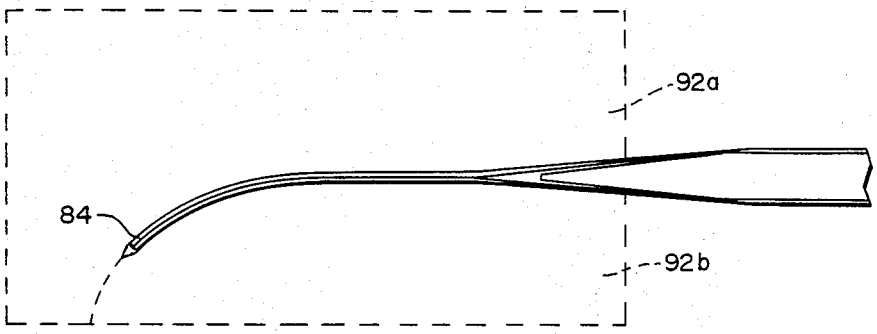
FIG. 18
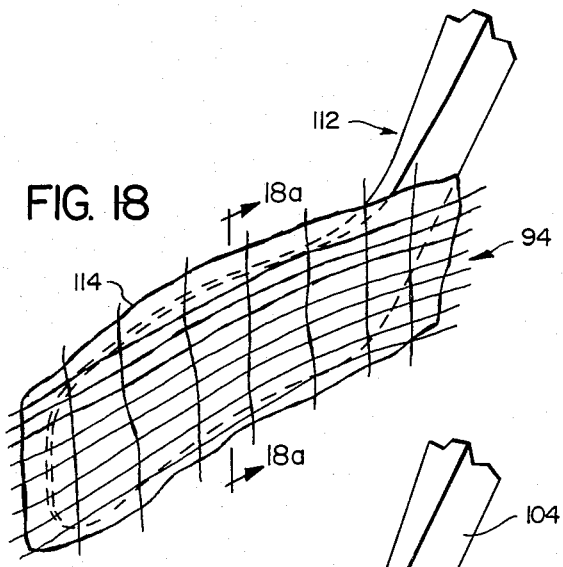
FIG. 18a
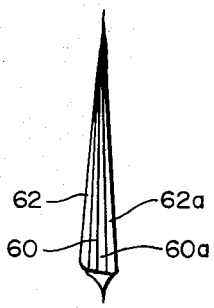
FIG. 19
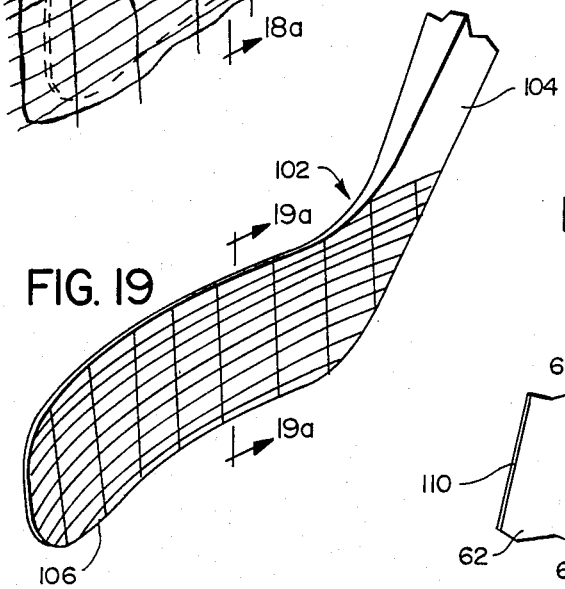
FIG. 19a
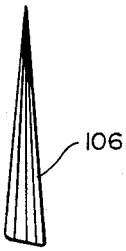
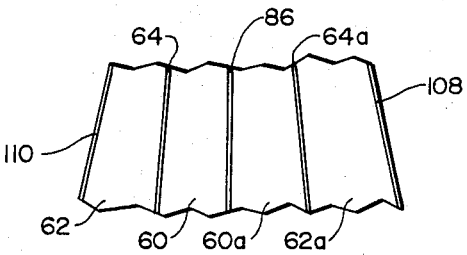
FIG. 19b FIG. 21a
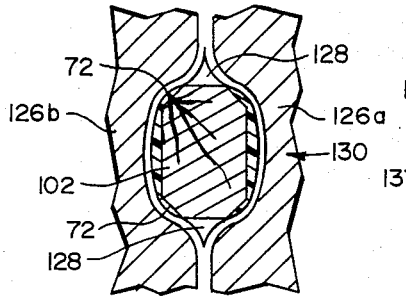
FIG. 22a
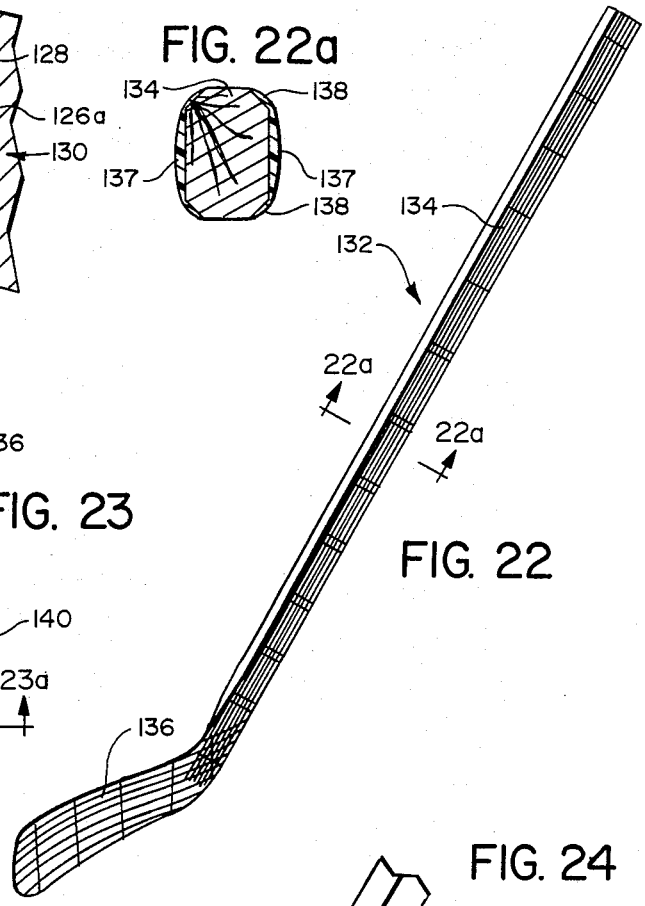
FIG. 22
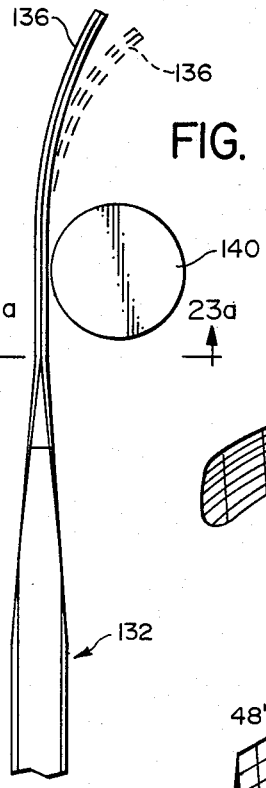
FIG. 23
FIG. 24
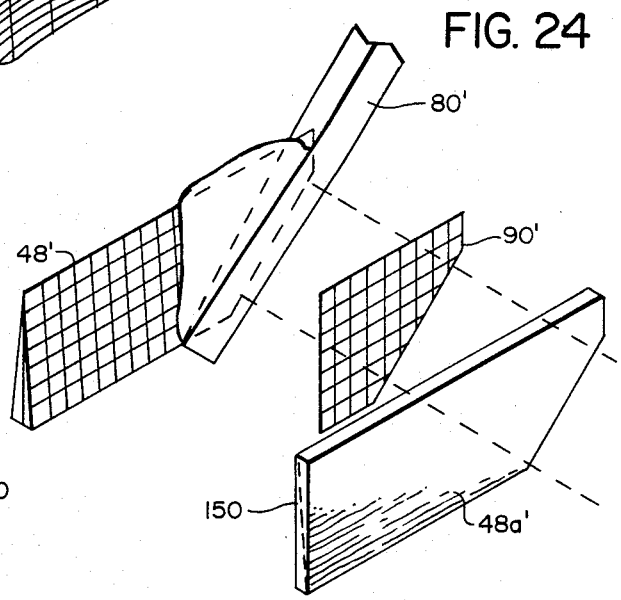
FIG. 23a
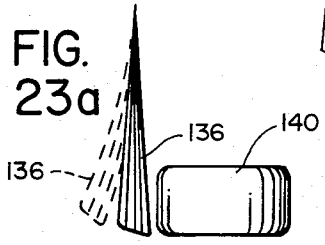

HOCKEY STICK HAVING LAMINATED BLADE STRUCTURE

This application is a continuation of U.S. application Ser. No. 300,123, filed Sept. 8, 1981, entitled "Hockey Stick and Method of Manufacture", now abandoned, which in turn is a continuation of U.S. patent application Ser. No. 171,126, filed July 22, 1980, now abandoned, which in turn is a continuation-in-part of U.S. application Ser. No. 056,421, filed July 10, 1979, entitled "Hockey Stick and Method of Manufacturing the Same", now issued as U.S. Pat. No. 4,369,970, issue date being Jan. 25, 1983.

BACKGROUND OF THE INVENTION

The present invention relates to hockey sticks and a method of making the same.

In a conventional hockey stick there is an elongate shaft, and a blade extending outwardly from the lower end of the shaft at an angle of about 40° to 50° from the longitudinal axis of the shaft. The heel portion of the blade (i.e. that portion which joins to the shaft) is moderately thinner than the thickness dimension of the shaft, and the thickness dimension of the blade decreases toward the toe end of the blade. Also, the lower part of the blade is generally made thicker, with the upper edge of the blade being relatively thin (e.g. an ⅛th of an inch).

The lower end of the shaft is generally formed with a gradual downward taper which contours smoothly into the configuration of the blade. This is done for two reasons. First, by removing excess material at the lower end of the shaft, the stick becomes lighter to handle. Second, for reasons of esthetics it is desirable to form the stick with more graceful contours.

One of the problems involved with the prior art hockey stick that is currently in common use is the manufacturing time in achieving the proper contour of the lower end of the stick. While this prior art method will be described in more detail later herein, with reference to FIGS. 1*a* through 1*d*, it can be stated generally that this is accomplished by first joining the component parts one to another, and then subjecting the assembled components to a grinding or "sanding" operation to remove excess material and provide the proper contours. This considerable amount of precision grinding adds substantially to the overall expense of manufacture.

Another problem with the general type of hockey stick presently being used involves the durability of the stick. The blade portion of the stick must have a certain amount of flexibility so that the player can obtain the proper "feel" in handling the puck and executing the shots. However, the stick is subjected to very substantial impacts, for example in the player executing a very hard "slap shot". It is not uncommon for a hockey stick to break after the execution of perhaps as many as fifty slap shots. Generally the stick breaks along the lower portion of the shaft, at the middle of the blade, or at the joint of the blade and the shaft. It is not an adequate solution to simply place more reinforcing material in the lower part of the stick, since this would add to the weight at the lower end of the stick and depart from the desired contour.

With regard to the patent literature relating to hockey sticks, a number of United States patents were disclosed in a patentability search. While these are not considered to be closely relevant to the teachings of the present invention, these are being cited herein to be sure that the applicant is complying with his responsibility in making a full disclosure to the U.S. Patent and Trademark Office.

U.S. Pat. No. 1,438,030, Hall, discloses a hockey stick where the blade is formed of upper and lower pieces, with upper extensions of the blade fitting on opposite sides of the shaft.

U.S. Pat. No. 1,564,125, Cordwell, shows a hockey stick or paddle where the grain of wood has a particular orientation with alignment of the stick.

U.S. Pat. No. 1,601,116, Hall, discloses a hockey stick having various tongue and groove connections between the shaft and the blade.

U.S. Pat. No. 1,631,960, Hall, shows yet another tongue and groove connection by which the blade is connected to the shaft.

U.S. Pat. No. 1,821,889, Glahe, shows a hockey stick having reinforcement pieces inserted into the blade.

U.S. Pat. No. 2,023,728, shows a hockey stick where the blade and handle are joined by an intermediate piece. This intermediate piece has a double wedge configuration and fits in V-shaped recesses in the shaft and blade.

U.S. Pat. No. 2,304,322, Werlich, has a hockey stick where the shaft is bifurcated at its lower end to receive the blade.

U.S. Pat. No. 2,334,860, Berger, shows another hockey stick where the blade is attached to the shaft by a tongue and groove connection.

U.S. Pat. No. 2,569,395, Zupanick, employs a laminated shaft having at its lower end a "V" slot to receive a tapered tongue at the heel of the blade. The blade itself is laminated and has a tapered configuration.

U.S. Pat. No. 2,730,367, Bublik, also shows a blade having a tongue member which fits into a slot in the shaft. Cane strips bonded by adhesive are employed to add strength.

U.S. Pat. No. 3,638,942, Bassett, shows a blade having a socket which receives the end of the shaft. Either the blade or the shaft are replaceable.

U.S. Pat. No. 3,982,760 utilizes a material along the bottom edge of the blade to prevent excessive wear and thus prevent delamination of plastic laminates along the sides of the stick.

U.S. Pat. No. 4,013,288 shows the stick made as a single injection molded piece.

U.S. Pat. No. 4,084,818, Goupil et al, winds the blade portion of the stick with a thin filament, such as fiberglass yarn.

U.S. Pat. No. 4,086,115, Sweet et al, utilizes a shaft made of fiberglass and having a hollow recess. A tongue portion of the blade fits into the lower end of the shaft.

U.S. Pat. No. 2,260,218, Evernden, shows a hockey stick having a blade, a handle and an insert which fits between the blade and the handle.

U.S. Pat. No. 2,503,242, Yerger, shows a hockey stick where the blade section is slotted to interfit with the lower end of the handle, and an insert is interfitted between the blade and the handle.

Canadian Pat. No. 455,116, shows a hockey stick where the lower end of the handle has a slotted configuration, and the blade has a matching configuration to interfit with the handle.

Canadian Pat. No. 447,077 also shows a blade with a slotted configuration that receives an insert, and the blade interfits with the insert.

British Specification 261 shows a cricket bat handle made of layers of cane, mock buckskin and india-rubber.

Swedish Pat. No. 84,147 shows a stick made up of two laminations.

SUMMARY OF THE INVENTION

In the method of the present invention, there is first provided an elongate handle member having an upper end and a lower end. Next, there is formed a blade member with a lengthwise axis. This blade member is attached to the handle member, with the blade member having at least two laminations. At least one lamination has a grain orientation generally slanted with respect to the lengthwise axis of the blade member. The grain orientation should be such that it is between an angle of 15° and 75° with the lengthwise axis of the blade. The preferred range is 25° to 65°, and the desired orientation being half of a right angle with respect to the lengthwise axis.

Also, it is preferable that at least one of the laminations has its grain orientation generally parallel to the lengthwise axis. In the preferred form, there are at least three laminations, comprising two outside laminations and one inside lamination. The inside lamination is that which has its grain orientation slanted with respect to the lengthwise axis of the blade.

In one embodiment there are at least four laminations, comprising two outside laminations and two inside laminations. One of the inside laminations has its grain orientation slanted with respect to the lengthwise axis of the blade in one direction, and the other inside lamination also has its grain orientation slanted with respect to the lengthwise axis of the blade, but in an opposite direction.

In the preferred method of assembly, there are provided two blade sections and a pliable hardening filler material. The heel portions of the blade sections are positioned on opposite sides of the lower portion of the handle, and to toe portions of the two blade sections extend outwardly from the handle and join to one another. The filler material is positioned in an area between the blade sections, with the filler material hardening to form with the blade sections the blade of the stick.

The one blade section is placed against the lower end of the stick, after which the filler material is placed against the one blade section. Then the second blade section is placed against the lower end of the stick, with the components then being bonded to one another. Desirably, at least one of the blade sections, and preferably both of the blade sections, is formed with an upwardly tapered cross-sectional configuration, with the top edge or edges being thinner than the lower edge or edges. Preferably, a fibre reinforcing material is positioned between the set or sets of laminations, and also fibre reinforced material is placed between the two blade sections.

The stick made according to the present invention has an elongate handle and a blade. The blade has at least two laminations, the grain orientation of at least one of which is slanted with respect to the lengthwise axis of the blade. The particular configuration and positioning of the lamination of the stick is in accordance with those specified previously in the description of the method of the present invention. Desirably, the handle portion has a rectangular cross-setional configuration, and the edge portions are bevelled. As a final step in the process, the front and rear surfaces of the handle have fibre reinforced material bonded thereto, and this material extends over the bevelled edge portions for added strength.

In the end configuration of the preferred embodiment, there are four laminated sections of the blade, namely two inside sections and two outside sections. The two inside sections have grain orientation slanted with respect to the lengthwise axis of the blade, with the two grain orientations being slanted opposite to one another. The outer laminations have grain orientation parallel to the lengthwise axis of the blade. Fibre reinforcing is provided between each adjacent pair of laminations, and also along the outside surfaces of the blade.

Other features will become apparent from the following detailed description.

BRIEF DESCRIPTION OF THE DRAWINGS

FIG. 14 is an isometric view of the bonded assembly after it is removed from the press of FIG. 13, with FIG. 14*a* being a sectional view;

FIG. 15 is a side view of the assembly of FIG. 14, showing the portions of the assembly which are cut away to give the blade section its final edge configuration, with FIG. 15*a* being a sectional view;

FIG. 16 shows the blade and lower handle section of FIG. 15, in position to be joined to two outer fiberglass layers;

FIG. 17 shows the components of FIG. 16 being bonded together in a press;

FIG. 18 shows the blade and lower handle section of the stick after being removed from the press of FIG. 17, with FIG. 18*a* being a sectional view;

FIG. 19 shows the blade and lower handle portion of the stick after the excess material is removed from the blade as shown in FIG. 18, with FIG. 19*a* being a sectional view; and with FIG. 19*b* being an enlarged view of a portion of the blade;

FIG. 21*a* is a sectional view showing the configuration of the handle in the press;

FIG. 22 shows the final stick configuration after the removal of the excess material on the handle, which material results from the bonding operation of FIG. 21;

FIG. 22*a* is a sectional view taken from FIG. 22;

FIG. 23 is a view looking down on a blade of the hockey stick of the present invention impacted by a puck, to show the manner in which the force of the impact is transmitted into the blade structure, with FIG. 23*a* being a sectional view; and FIG. 24 is a sectional view similar to FIG. 12, showing a second embodiment.

DESCRIPTION OF THE PREFERRED EMBODIMENT

It is believed a clearer understanding of the present invention will be obtained by first describing, with reference to FIGS. 1*a* through 1*d* the common method for manufacturing the prior art hockey stick now commonly in use. After that, there will be a detailed description of the method of the present invention followed by a more detailed description of the characteristics of the hockey stick of the present invention.

Figure 1A:
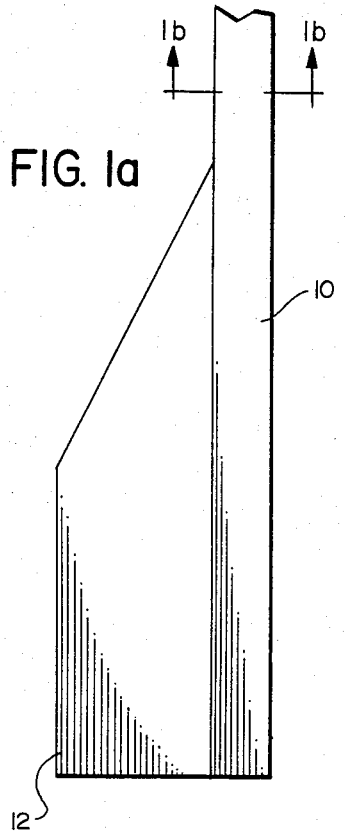
FIG. 1*a* is a perspective view showing an initial joining of a shaft and a connecting member as a first step in making a conventional prior art hockey stick.
Figure 1B:
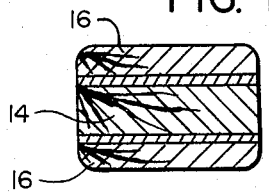
FIG. 1*b* is a sectional view taken at line 1*b*—1*b* showing the cross section of the shaft of the prior art hockey stick.

As shown in FIG. 1*a*, the initial step in manufacturing a prior art hockey stick is to provide an elongate shaft 10 (only the lower part of the shaft 10 being shown in FIG. 1*a*) and joining to that shaft 10 (e.g. by bonding) a trapezoidal connecting member 12. As can best be seen in FIG. 1*b*, quite commonly the shaft 10 has a core section 14 and two side laminated sections 16. Generally, the laminated sections 16 are made of a higher quality veneer wood product, and can withstand greater unit force loads, while the core section 14 (being stressed to a relatively lesser extent) can be a combination of laminated members, some of which are less able to withstand high loading.

Figure 1C:
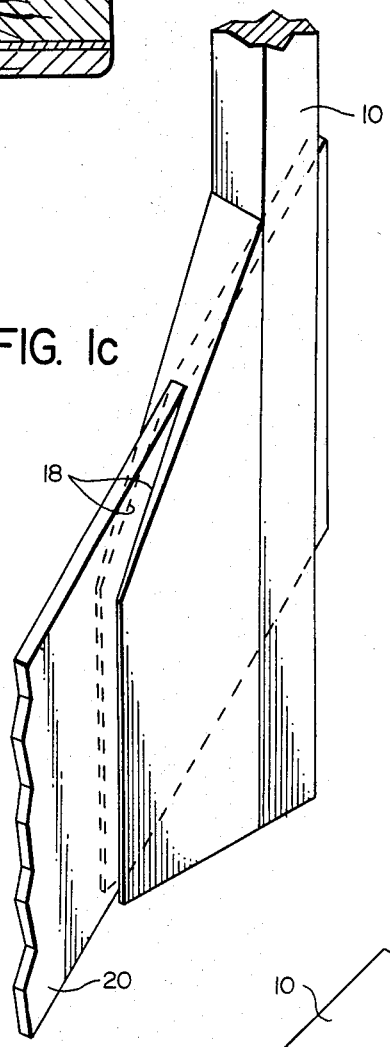
FIG. 1*c* shows the same components of FIG. 1*a* with a receiving slot formed in the connecting member.
Figure 1D:
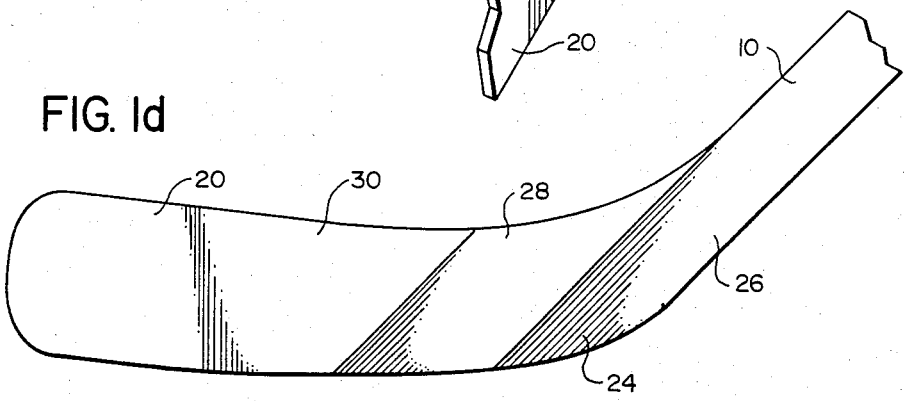
FIG. 1*d* shows the completed prior art hockey stick with the blade inserted in the receiving slot and the outer contour of the shaft ground to the proper configuration.

With the connecting member 12 being bonded to the shaft 10, the next step, as shown in FIG. 1*c*, is to cut an elongate groove or slot 18 into the forward portion of the connecting member 12. Next, a blade member 20 is inserted into the slot 18 and bonded to the connecting member 12. With the basic components of the hockey stick now assembled and bonded together, the next step is to contour this assembly into a finished product indicated at 22 in FIG. 1*d*. First, the heel portion 24 is rounded off, for example by grinding or sanding. Next, there is a grinding action to provide a gradual taper along the lower side surfaces 26 of the shaft 10. This grinding is continued into the side portions 28 of the connecting member 12 so that it follows a gradual contour from the surface 26 to the side surface 30 of the blade 20. These grinding or material removal operations result in the conventional configuration of the hockey stick 22 shown in FIG. 1*d*. After the grinding operation, the lower shaft and blade surfaces are reinforced with a fiberglass resin mat.

When the hockey stick 22 is used for a period of time and subjected to a number of very hard impacts (e.g. used in a slap shot), it is not unusual for the hockey stick 22 to break. Generally, the break will occur in the lower portion of the shaft 12, at the middle of the blade, or at the joint between the shaft and the blade. This is not unexpected, since in the final grinding operation the side material of the shaft (i.e. the side laminated portions 16) is ground away thus diminishing the ability of the lower portion of the shaft to withstand bending moments.

It is with the foregoing problems in mind that the present invention was conceived. More particularly, the present invention was designed to provide relatively fast and inexpensive manufacturing, and also an end product which has relatively high ability to withstand a series of hard impacts.

Figure 2A:
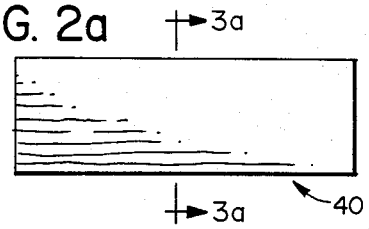
FIG. 2*a* and FIG. 2*b* show two pieces of wood which are bonded together as laminates to make a blade section.

To proceed now to a description of the present invention, the first step is to make a pair of blade sections which are later bonded to the handle to form the blade. In FIG. 2*a* there is shown a first piece of wood 40, having a rectangular configuration with its width and length dimensions moderately larger than the blade which is to be formed in the completed hockey stick. The grain of the wood in the piece 40 runs parallel to the length-wise dimension of the piece 40.

Figure 2B:
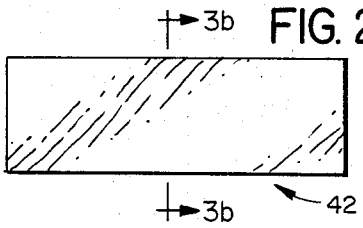
Figure 3A:
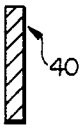
FIGS. 3*a* and 3*b* are sectional views of FIGS. 2*a* and 2*b*, respectively.
Figure 3B:
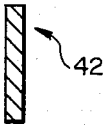
Figure 4:
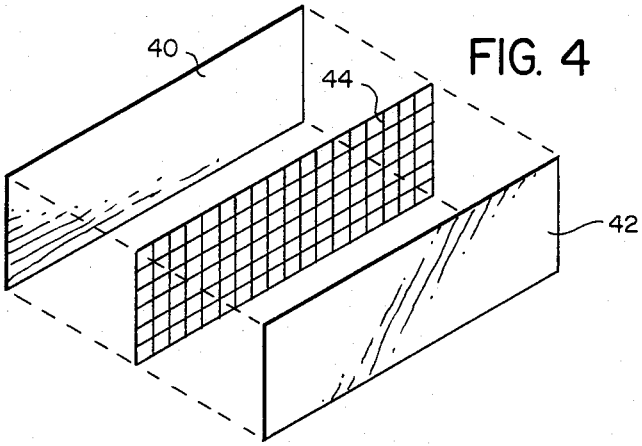
FIG. 4 is an isometric view showing the manner in which the two pieces of wood are bonded together to make a laminated piece which is to be one of the two blade sections.

In FIG. 2*b* there is shown a second wood piece 42 which has substantially the same size and shape as the piece 40. However, the grain of the wood piece 42 slants at approximately a 45° angle to the length-wise dimension of the piece 42. The two wood pieces 40 and 42 are bonded together in the manner illustrated in FIG. 4. The two pieces 40 and 42 are placed on opposite sides of a rectangular fiberglass mat 44 having the same length and width dimensions as the wood pieces 40 and 42. Such a fiberglass mat 44 is well-known in the prior art, and comprises a plurality of interwoven fiberglass strands impregnated with a suitable resin. Some of the strands of fiberglass run parallel to the lengthwise dimension of the mat 44, while a second set of fiberglass strands run perpendicular to the length-wise dimension.

Figure 5:
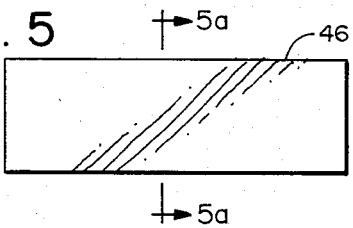
FIG. 5 shows a laminated section made from the components shown in FIG. 4.
Figure 5A:
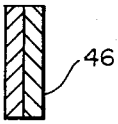
FIG. 5*a* is a sectional view taken in FIG. 5.

A suitable bonding agent is applied to all the surfaces to be joined, and the two wood pieces 40 and 42 and the mat 44 are pressed together to make a bonded laminated section, 46 which is shown in FIG. 5. It is readily apparent that this bonded section is made-up of the two outer wood laminations 40 and 42, with the middle fiberglass mat lamination 44, and with the grain of the two wood sections being offset 45° from one another. As will be disclosed more fully later herein, this 45° offset orientation of the wood grain adds substantially to the ability of the hockey stick to resist shear forces.

Figure 6A:
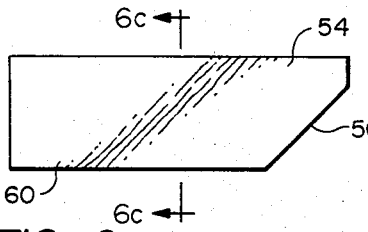
FIG. 6*a* illustrates the laminated section of FIG. 5 after it has been shaped to the proper configuration.
Figure 6B:
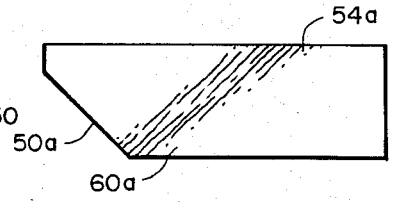
FIG. 6*b* illustrates a second laminated section which is a mirror image of the laminated section of FIG. 6*a*.
Figure 6C:
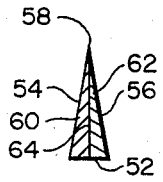
FIG. 6*c* is a sectional view taken fron FIG. 6*a*.

The next step is to shape the laminated section 46 to form a blade section of the proper configuration, this blade section being shown at 48 in FIGS. 6*a* and 6*c*. To accomplish this, one lower portion laminated section 46 is cut off to leave a slanted edge portion 50. This slanted edge portion 50 is later to become the lower heel portion of the blade which is eventually formed. Next, side portions of the wood pieces 40 and 42 of the laminated section 46 are subjected to a material removal operation to provide a tapered configuration, such as shown in FIG. 6*c*. This removal step can be performed in any one of a number of conventional ways, such as sawing, grinding or planing the laminated section 46. The resulting configuration is such that in cross-sectional configuration, the blade section 48 has its lower edge 52 at a greater thickness, with the side surfaces 54 and 56 tapering inwardly in an upward direction to the top edge 58.

In further decribing the blade section 48, the wood lamination having its grain oriented at 45° to the lengthwise axis of the blade section 48 (formerly wood piece 42) will now be designated 60, while the other laminated wood section (formerly wood piece 40) with the grain orientation parallel to the length-wise axis of the blade section 48 will be designated 62. The fiberglass mat 44, which is now bonded to the section 60 and 62, will hereafter be designated 64.

After forming the first blade section 48, a second blade section (shown at 48*a* in FIG. 6*b*) is made in the same manner as the blade section 48, with two exceptions. First, the second section 48*a* is a mirror image of the blade section 48, in that the position of the two sections 60 and 61 are reversed. In other words, in the view of FIG. 6*c*, the second section 48*a* would have the wood piece with the grain oriented at 45° to the lengthwise axis on the right side of the blade section 48, and the other wood piece would have the grain parallel to the lengthwise axis. The second exception is that the blade section has the grain of one of its wood pieces slanted in a direction which in the end configuration of the blade will be perpendicular to the direction of the grain in the wood piece 60 of the first section 48. Thus, with reference to FIG. 6*b*, the grain of the one piece 60*a* of the second blade section is in a direction perpendicular to the slanted lower edge portion 50. The significance of this grain orientation will become apparent later in this description where it is disclosed how the two blade sections are connected to the handle to form the hockey stick.

Figure 7:
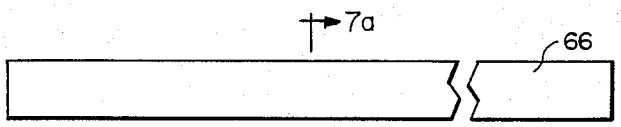
FIG. 7 is a side view of a handle portion of the stick, with FIG. 7*a* being a sectional view of FIG. 7.
Figure 7A:
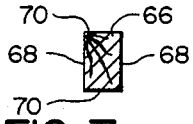

The next step is to form the handle to the proper configuration, and this will be described with reference to FIGS. 7 through 10. In FIGS. 7 and 7*a*, there is shown an elongate wood rod 66 having a rectangular cross-sectional configuration, this wood rod 66 having two side surfaces 66 of moderately greater dimension, and two other side surfaces 70 of lesser dimension.

Figure 8:
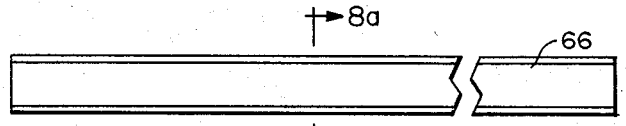
FIG. 8 is a view of the handle of FIG. 7 after the edges are bevelled, with FIG. 8*a* being a sectional view of FIG. 8.
Figure 8A:
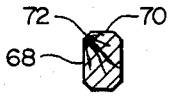
Figure 9:
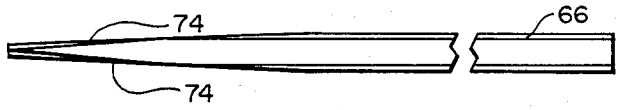
FIG. 9 illustrates the handle of FIG. 8 after side portions thereof have been cut to a taper configuration.

The first step in forming the handle is to bevel the edge portions of the rod 66 where the surfaces 68 and 70 meet. This can be done in a conventional manner, and the bevelled surfaces are illustrated at 72 in FIG. 8*a*.

Figure 10:
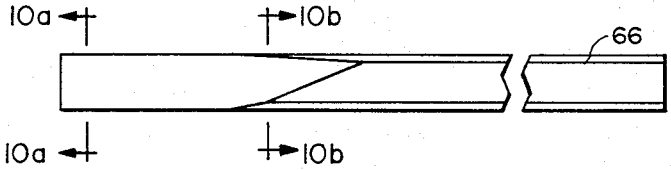
FIG. 10 is a view of the handle of FIG. 9, with the handle being turned 90° from the position of FIG. 9.
Figure 10A:
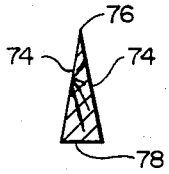
FIGS. 10*a* and 10*b* are sectional views of FIG. 10.
Figure 10B:
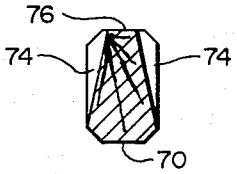

The next step is to shape that portion of the rod 66 which is to become the lower portion of the handle in a tapered configuration. This can be done in a conventional material removal operation, such as by sawing, grinding, etc. This results in the lower end of the rod 66 being formed with two tapered side surfaces 74. The tapered configuration is such that the taper is not only inwardly toward the lower end of the rod 66, but there is also a moderate taper toward one surface 70. This taper is shown in a somewhat exaggerated form in FIGS. 10*a* and 10*b*. Thus, in FIG. 10*a* it can be seen that the rod's one edge 76 is substantially narrower than the rear edge 78.

With the rod 66 shaped in the manner indicated in FIGS. 9, 10, 10*a* and 10*b*, it now has the configuration of the handle which is to be attached to the two blade sections 48 and 48*a*. In the description which follows, this handle will have the numerical designation 80.

Figure 11:
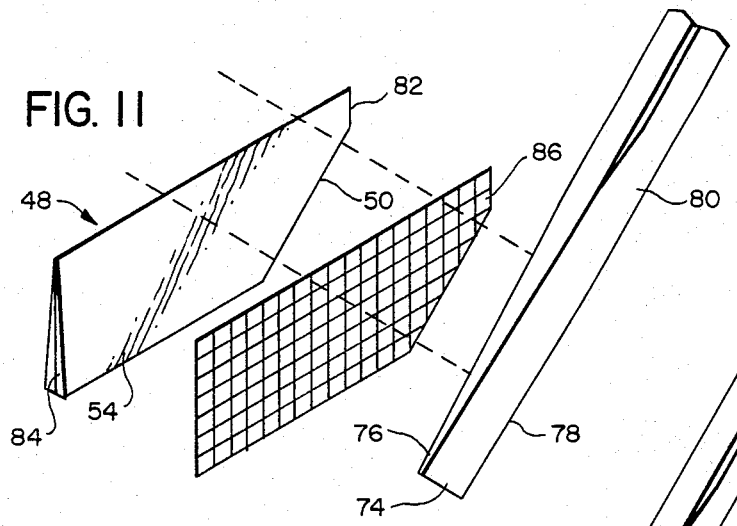
FIG. 11 is an isometric view, showing one of the blade sections, a fiberglass layer and the handle, is position to be joined to one another.

In FIG. 11, there is shown the lower portion of the handle 80 about to be joined to the first blade section 48. For purposes of description, the end portion 82 of the blade section 48 which is adjacent to the slanted edge 50 will be considered the "inner" or "heel" portion of the blade, while the opposite end 84 will be considered the "outer" or "toe" end. The surface 54 of the blade section 48, which is facing toward the handle 80, will be considered the "forward" surface while the opposite surface 56 (hidden in FIG. 11) will be considered the rear surface.

With further reference to FIG. 11, there is provided a fiberglass mat 86 having the same configuration as the blade section 48. Glue or some other adhesive substance is applied to the surface 54, and the fiberglass mat 86 is soaked in glue and placed between the surface 54 and the handle 80. Next, the mat 86 is pressed against the surface 54 so that the edge portions of the mat 86 and the blade section 48 are aligned. An adhesive substance is also applied to the lower rear surface portion of the handle 80, and the blade section 48 and mat 86 are pressed against the lower rear portion of the handle 80 so that the slanted edge 50 of the blade section 48 is aligned with the edge portion 78 of the handle 80. The blade 48 is temporarily held in place, this being easily accomplished by inserting small nails or staples through the section 48 and into the handle.

Figure 12:
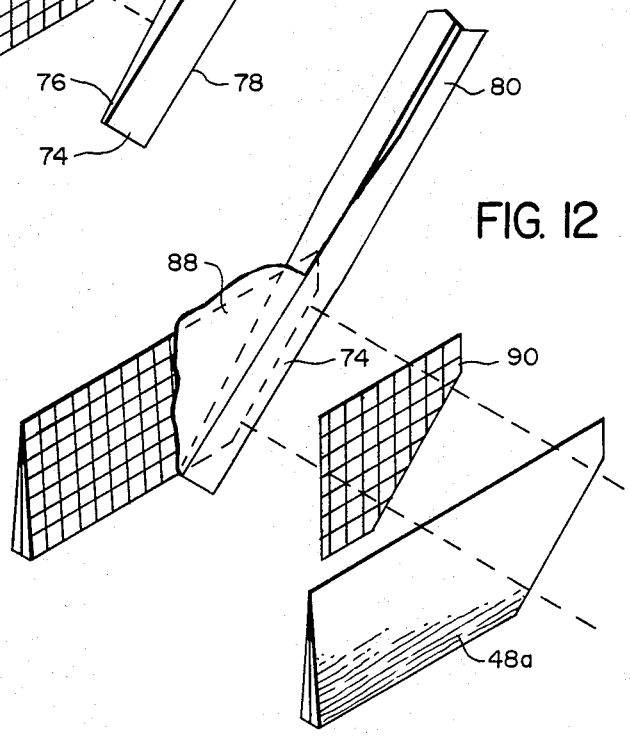
FIG. 12 is a view similar to FIG. 11, showing the components of FIG. 11 joined together, and a second blade section and fiberglass layer in position to be joined to the other components.

Next, as illustrated in FIG. 12, a pliable filler material 88 is placed against the inner front surface portion of the blade section surface 54 and also against the outward facing surface portion 76 of the handle 80. This filler material 88 can be made of a variety of substances, and it has been suitable to form this material 88 by mixing an epoxy glue with cellulose fibers. Such cellulose fibers are sold marked under the trademark "Celluflock", and are sold by the Georgia Pacific Company. This filler material, before hardening, has a putty-like consistency, and can easily be shaped or molded into the general recess defined by the blade section 48 and the handle 80.

Next, with further reference to FIG. 12, there is provided another piece of fiberglass mat 90, having the same general configuration as the fiberglass mat 86, but having a shorter length so that it will fit against only the inner or heel portion of the second blade section 48*a*. A glue or other bonding medium is applied to the rear surface of the blade section 48*a*, and also to the lower portion of the forward surface 74. Then, the fiberglass mat piece 90 is pressed against the rear inner surface of the blade section 48*a* and soaked with glue. Then the section 48*a* is pressed against the lower forward surface portion 74 of the stick 80. The blade section 48*a* is temporarily secured to the handle 80 by means of small nails or stapes.

Following the steps disclosed in FIGS. 11 and 12, the assembly which results from these steps is moved to a press, where the two blade sections 48 and 48*a*, along with the lower portion of the handle 80 are placed between two press members, indicated schematically at 92*a* and 92*b*. These two press components 92*a* and 92*b* have their working surfaces curved in a configuration to correspond closely to the end configuration of the blade of the hockey stick which is being manufactured. Thus, the outer or toe ends 84 of the blade sections 48 and 48*a* curve in a forward direction. It will be recognized from an examination of FIG. 13 that the hockey stick being made is a righthanded hockey stick, and the configuration would simply be reversed to make a left-handed hockey stick. Desirably the working surfaces of the two press components 92*a* and 92*b* are made of a moderately yielding material so that these will conform to the edge portions and to any small irregularities in the blade sections 48*a* and 48*b*.

Figure 13:
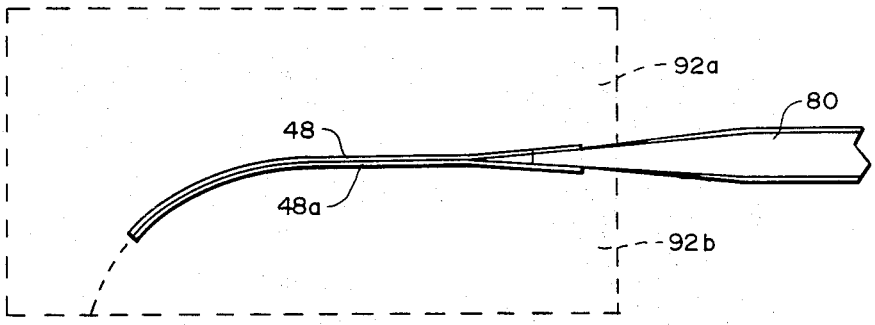
FIG. 13 is a top view showing the components of FIG. 12 being pressed together in a press for bonding.

The assembly shown in FIG. 13 remains in the press components 92*a* and 92*b* until the glue or other bonding medium and also the filler 88 have hardened. Then, the bonded assembly is removed from the press 92*a*–92*b*, and this bonded assembly is indicated at 94 in FIGS. 14 and 14*a*. It will be noted that some of the glue that was applied to the various surfaces is squeezed beyond the edge portions of the two blade section 48 and 48*a*, and also some of the filler material 88 is squeezed from the cavity between the blade sections 48 and 48*a*. This excess material is indicated generally at 96. The bonded assembly 94 shown in FIGS. 14 and 14*a* has the two blade sections 48 and 48*a*, the two fiberglass mat portions 86 and 90 and the lower portion of the handle 80 firmly bonded to one another in a single assembly. Also, the filler material 88 is in a hardened condition and fills the cavity that exists between the inner portions of the two blade sections 48 and 48*a*.

The bonded assembly which is shown in FIGS.14 and 14*a* now has its edge portions cut or ground to the desired edge configuration of the finished hockey stick which is to be manufactured. The manner in which this is done is indicated somewhat schematically in FIG. 15, where the assembly is shown in front view. The general perimeter of the bonded assembly of FIG. 14 is indicated in broken lines at 98, and the edge portion of the bonded assembly as it is cut to the proper configuration is indicated at 100. For purposes of description, the bonded stick assembly which results from the cutting step of FIG. 15 is designated generally 102.

The stick assembly 102 can be considered as having a handle portion 104 and a blade portion 106. The next step is to bond a pair of fiberglass mats 108 and 110 to, respectively, the front and rear faces of the blade 106. This is accomplished by applying a glue or other bonding medium to the front and rear surfaces of the blade 106 and to the mats 108 and 110, pressing the mats 108 and 110 against the front and rear surfaces, and again placing these in the press 92*a*–92*b*. This step is illustrated in FIG. 17, and the assembly 102 remains in the press until the bonding is completed.

The bonded assembly which results from the steps indicated in FIG. 16 and 17 is generally designated 112, and it can be seen that edge portions 114 of the two fiberglass mats 108 and 110 extends beyond the perimeter portion of the stick assembly 112.

Figure 20:
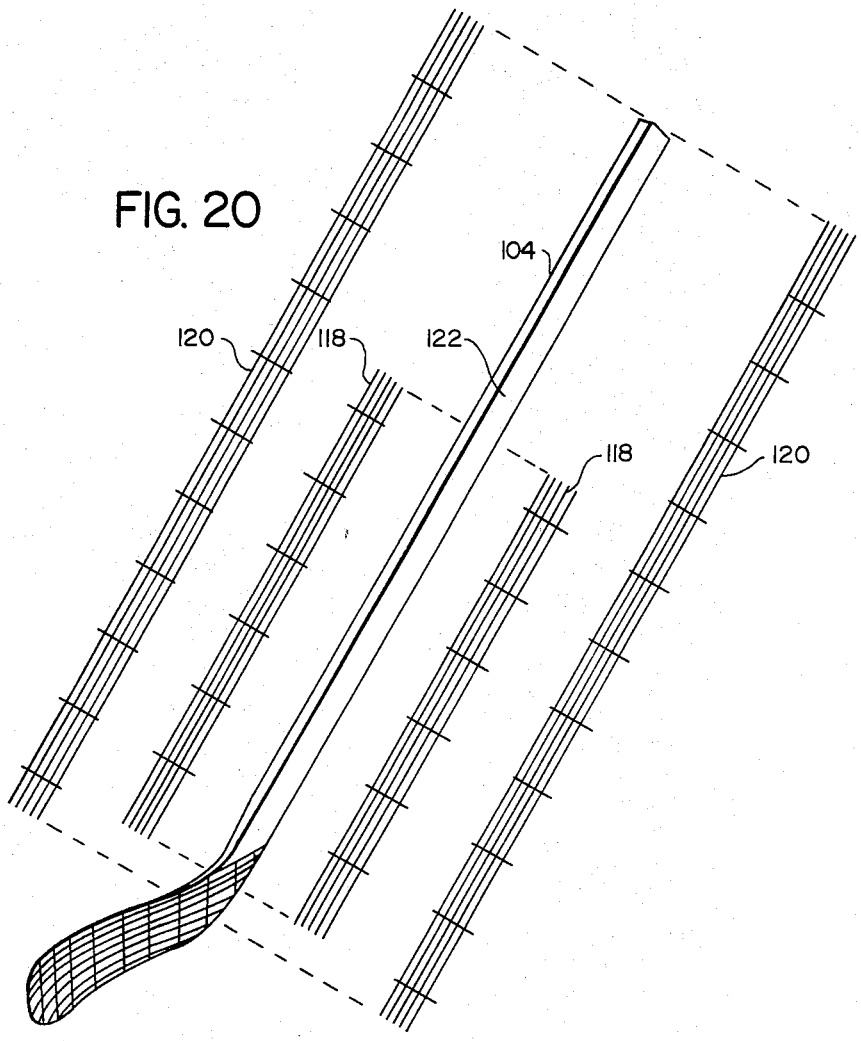
FIG. 20 shows the stick as it exists from FIG. 19, with four fiberglass layers in position to be joined to the handle portion of the stick.

The excess fiberglass mat portions 114 are simply ground away from the rest of the bonded assembly 112, to leave the assembly 112 in the configuration shown in FIG. 19. The bonded stick assembly 112, in the configuration shown in FIGS. 19 and 19*a*, now has additional fiberglass mat reinforcing applied to its handle portion 104. This is accomplished as shown in FIG. 20, where there are shown two shorter lengths of fiberglass mat 118 and two longer lengths 120. A suitable glue or bonding medium is applied to the surfaces to be bonded one to another and to the fibreglass mats, and the two shorter mat sections 118 are applied to the front and rear surfaces of the handle portion 104. (In FIG. 20, only the front surface 122 of the handle 106 is shown). Next, the two longer fiberglass mat pieces 120 are soaked in glue and applied to the front and rear surfaces of the handle 106. The longer fiberglass mat pieces 120 extend the entire length of the handle 104 and also over the heel portion of the blade 106. The shorter fiberglass mat pieces 118 have their lower edges just at or above the heel portion of the blade 106 and terminate moderately above the mid-length of the handle 104.

Figure 21:
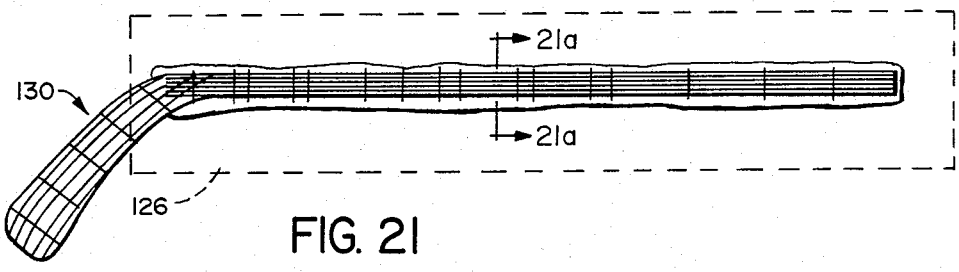
FIG. 21 shows the components of FIG. 20 being bonded together in a press.

With the fiberglass mat pieces 118 and 120 applied to the stick assembly 112, the stick assembly is placed in a press, indicated schematically at 126 in FIG. 21. The two parts of the press 126*a* and 126*b* are made of a resilient or yielding material which forms around the bevelled edges 72 of the handle 104.

Thus, the edges of the four fiberglass mat pieces 118 and 120 form around the bevelled edges 72 as shown in FIG. 21*a*. Some of the glue or other bonding material extrudes out from beneath the fiberglass layers 118 and 120 and forms in two side pockets indicated 128. The bonded stick assembly which results from the pressing and bonding operation illustrated in FIGS. 21 and 21*a* is generally designated 130.

The next and final step in forming the hockey stick of the present invention is to remove the excess glue or other bonding material, and any of the fiberglass material that extends beyond the bevelled edges 72 of the handle 116. This can be done in a conventional manner, such as by cutting, sawing or grinding. The end configuration of the hockey stick which results from this final material removal operation is designated 132 and is illustrated in FIGS. 22 and 22*a*. The handle portion of the stick is designated 134, while the blade portion is designated 136. The handle portion 134 thus has fiberglass reinforcing 137 on both its front and rear faces. In addition, this fiberglass reinforcing extends around all four bevelled edges, as at 138. This particular configuration of the fiberglass reinforcing 137-138 contributes to the overall strength imparted to the handle 134.

Attention will now be directed to the blade portion 136 of the finished hockey stick 132, and the structural and functional advantages of this blade 136 will now be discussed. To review briefly some of the structural features of the blade 136, attention is directed to FIGS. 6*a* and 6*c*. It is noted that the front surface 54 of the rear blade 48 has the grain of the wood slanting at approximately a 45° angle in a downward and outward direction. It will also be noted that the rear surface 54*a* of the forward blade section 48*a* has the grain of the wood slanting in a downward and inward direction (i.e., toward the heel) which is at a 90° to the grain of the wood at the surface 54 of the rear blade section 48. With regard to the lengthwise axls of the fiberglass reinforced reinforced mat 86 (see FIG. 11), the grain of the wood at 54 and 54*a* are both at 45° to this lengthwise axis of the mat.

For purposes of further analysis, attention is directed to FIG. 19*b* where a portion of the blade 136 is shown in cross section in its finished configuration. It will be noted that there are two outside laminations 62 and 62*a*, and also two inside laminations 60 and 60*a*. Also, there are five fibre-glass reinforced layers, namely the two outside layers 108 and 110, and three inside positioned layers 86, 64 and 64*a*. The grain of the two inside laminations 60 and 60*a* are each at approximately 45° to the lengthwise axis of the blade 106, and the grain orientations of these two sections 60 and 60*a* are at approximately right angles to each other. The grain orientations of the two outside laminated sections 62 and 62*a* are generally parallel to the lengthwise axis of the blade 106.

It is known that when either compression or tension forces are applied parallel to the grain of the wood, the wood can withstand higher unit pressures than when the force is applied at an angle to the grain of the wood. Conversely, with regard to shear forces the wood is much better able to withstand shear forces when these are applied along a slanted angle (e.g. 45°) to the grain of the wood.

With the foregoing in mind, let us now turn our attention to FIGS. 23 and 23*a* which show a puck 140 impacting the blade 136 when a player is using the stick 132 to execute a hard slap shot. (In FIGS. 23 and 23*a*, a left handed stick 132 is shown.) The blade 136 is shown in full lines at the moment of impact, with the blade 136 not being deflected, and the blade 136 is shown in broken lines very shortly after the moment of impact. When the puck 140 meets the blade 136, the momentum of the blade 136 is abruptly changed, causing the outer portion of the blade 136 to deflect forwardly (as shown in the broken lines of FIG. 23.) Thus, there are very abrupt and rather substantial tension forces applied along the backside of the blade 136, and rather high compression forces exerted on the front side of the blade 136. In the middles portion of the blade, the compression and tension forces diminish to a zero point at a neutral plane at approximately the middle of the blade 136. However, there are substantial shear forces imparted to the blade 136, and these are at a high level in the middle portion of the blade 136.

With reference to FIG. 123, it can be seen that when the puck 140 engages the lower part of the blade 136, the lower part of the blade 136 tends to deflect rearwardly relative to the upper part. This causes tension forces in the forward surface portion of the blade 136, and compression forces in the rear part. However, these tension and compression forces are exerted along a vertical line of application.

With the foregoing in mind, reference is made back again to FIG. 19*b*. The tension and compression forces applied to the surface portions of the blade are resisted to a large extent by the outside laminated portions 62 and 62*a*, which have the grain of the wood parallel to the lengthwise axis of the blade, this being the optimum orientation for withstanding these forces. On the other hand, the rather substantial shear forces are withstood largely by the inside laminated portions 60 and 60*a*, which have a slanted grain orientation and are thus optimized for withstanding these shear forces. With regard to the various fibre-glass mat reinforcing, the outside layers 108 and 110 are also helpful in resisting the compression and tension forces. The inside layers 86, 64 and 64*a* act between the laminated portions 60, 62, 60*a* and 62*a* (all of which have different grain orientations with respect to one another) in a manner to enable these laminated sections to cooperate to withstand the shear forces.

With regard to the orientation of the grain in the inside laminated section 60 and 60*a*, within the broader range, the grain could vary from the 45° angle possibly as much as 30°, which would make a range of orientation between 15° to 75° to the lengthwise axis. Desirably, the grain orientation would be within an angular range of 25° to 65° with the lengthwise axis of the blade 136.

With regard to the handle portion 134, reference is made to FIG. 22*a*. With the fibre-glass mat reinforcing extending around the bevelled edge portions at 138, the fibre-glass mat reinforcing is much better able to withstand the forces exerted on the handle 134. Also, it is possible to imprint letters, numerals or other designations along the forward or rear wood surface of the handle 134, after which the fibre-glass reinforcing is applied. In this manner, the hockey sticks could be serially numbered so that each individual stick could be identified, with the numerals being in a very safe location where removal would be extremely difficult.

FIG. 24 shows a second embodiment of the present invention. This second embodiment is quite similar to the first embodiment, except that the forward blade section is formed as a single piece of wood, rather than a laminated piece of wood. In describing this second embodiment, numerical disgnations will be given similar to the first embodiment as shown in FIG. 12, with prime (′) designation distinguishing those components of the second embodiment.

Thus, there is a handle 80′, a rear blade section 48′, a filler material 88′, and a fibre-glass reinforcing piece 90′. It is the forward blade section 48*a′* which is formed as a single rectangular piece of wood, with its heel portion cut to a slant as at 50′. The bonding operation in the embodiment of FIG. 24 is done in substantially the same manner as the bonding operation disclosed with reference to FIG. 12. Either prior to or after the bonding operation, the forward blade section is cut or ground along a slanted plane indicated in broken lines at 150 so as to give the forward blade section 48*a′* the tapered configuration that is desired.

Thus, in the end configuration of the embodiment shown in FIG. 24, there are a total of only three wood laminations in the blade section. Only the middle lamination has the grain orientation thereof slanted at an angle to the lengthwise axis of the blade.

According to the applicant's experience, it has been found that conventional hockey sticks will quite often break after the stick has been used to execute 50–100 hard slap shots. On the other hand, it has also been found that hockey sticks made according to the present invention can be used to execute as many as several hundred hard slap shots without breaking. Further, the manner of making the handle permits a lighter weight wood to be used.

What is claimed is:

1. A game stick, such as a hockey stick, comprising:

a. an elongate handle member having an upper end and a lower end;

b. a blade member with a lengthwise axis and a heel portion attached to said handle member, said blade member having at least two laminations, with at least one lamination having a grain orientation generally slanted with respect to the lengthwise axis of the blade member;

c. said blade member comprising two blade sections and hardened filler material with heel portions of the blade sections being positioned on opposite sides of the lower portion of the handle member, and toe portions of the two blade sections extending outwardly from the handle member and joined to each other, and the filler material being located in an area between the blade sections, and hardened to form with the blade sections the blade of the stick.

2. The stick as recited in claim 1, wherein each of said blade sections has an upper edge and a lower edge, at least one of said blade sections having an upwardly tapered cross sectional configuration, with the top edge being thinner than the lower edge.

3. The stick as recited in claim 2, wherein one of said blade sections has two laminate sections with a reinforcing material positioned between and joined to the two laminate sections, with at least one said laminate section being the laminate section having its grain orientation slanted.

* * * * *